US011721511B2

(12) United States Patent
Yurkanin

(10) Patent No.: US 11,721,511 B2
(45) Date of Patent: Aug. 8, 2023

(54) FUSE TERMINAL DESIGN

(71) Applicant: Littelfuse, Inc., Chicago, IL (US)

(72) Inventor: Matthew David Yurkanin, Mount Prospect, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 17/570,161

(22) Filed: Jan. 6, 2022

(65) Prior Publication Data

US 2023/0215676 A1 Jul. 6, 2023

(51) Int. Cl.
*H01H 85/43* (2006.01)
*H01H 85/143* (2006.01)
*H01H 85/165* (2006.01)

(52) U.S. Cl.
CPC ..... *H01H 85/143* (2013.01); *H01H 85/165* (2013.01); *H01H 85/43* (2013.01)

(58) Field of Classification Search
CPC .. H01H 85/143; H01H 85/147; H01H 85/153; H01H 85/157; H01H 85/165; H01H 85/43
See application file for complete search history.

(56) References Cited

U.S. PATENT DOCUMENTS 1,334,572 A * 3/1920 Trumbull ..... H01H 85/143 337/237
1,474,146 A * 11/1923 Feldkamp ..... H01H 85/38 337/276
1,596,234 A * 8/1926 Bogle ..... H01H 85/153 337/248
4,851,805 A * 7/1989 Poerschke ..... H01H 85/0411 29/418
5,569,894 A * 10/1996 Uchida ..... H01H 9/446 218/27
5,994,994 A * 11/1999 Ito ..... H01H 85/0418 337/248
2004/0183646 A1* 9/2004 Jollenbeck ..... H01H 85/0418 337/228
2013/0143478 A1* 6/2013 Arcos ..... H01H 33/08 454/184
2018/0138004 A1 5/2018 Schlaak

FOREIGN PATENT DOCUMENTS

GB 555767 A 9/1943

OTHER PUBLICATIONS

European Search Report and Written Opinion for the Application No. EP22216829, dated Jun. 6, 2023, 7 pages.

* cited by examiner

*Primary Examiner* — Jacob R Crum
(74) *Attorney, Agent, or Firm* — KDW Firm PLLC

(57) ABSTRACT

A fuse assembly includes a fuse element and a terminal vent channel. The fuse element is located between a first terminal and a second terminal. The fuse element breaks in response to an overcurrent event. The terminal vent channel is located in the first terminal and provides a path for the outgassing of debris during the overcurrent event.

9 Claims, 9 Drawing Sheets

FUSE TERMINAL DESIGN

FIELD OF THE DISCLOSURE

Embodiments of the present disclosure relate to fuse designs and, more particularly, to fuse designs to facilitate outgassing of materials.

BACKGROUND

Fuses are current-sensitive devices which are designed as the intentional weak link in an electrical circuit. The function of the fuse is to provide discrete component or complete circuit protection by reliably melting under overcurrent conditions and thus safely interrupting the flow of current.

When the fuse protecting a circuit breaks, an arc energy is created between the two terminals of the fuse. The arc energy causes the metal of the breakable portion of the fuse element, as well as other materials, to melt and deposit within the fuse housing. The debris path, including molten material of the fuse element, carbonized plastic of the housing, and hot gases, may be electrically conductive. A poorly designed fuse may thus transmit current across its terminals even though the fuse has broken.

One or more vents in the housing may provide a path outside the fuse for outgassing. The vents are designed to prevent the debris from forming electrically conductive path between the terminals. By molding the housing from plastic material, the vents can be placed in different locations of the housing. The vents created in the plastic material, however, may be damaged from assembly processes such as ultrasonic welding such that the vents do not have the intended shape or dimension.

It is with respect to these and other considerations that the present improvements may be useful.

SUMMARY

This Summary is provided to introduce a selection of concepts in a simplified form that are further described below in the Detailed Description. This Summary is not intended to identify key or essential features of the claimed subject matter, nor is it intended as an aid in determining the scope of the claimed subject matter.

An exemplary embodiment of a fuse assembly in accordance with the present disclosure may include a fuse element and a terminal vent channel. The fuse element is located between a first terminal and a second terminal. The fuse element breaks in response to an overcurrent event. The terminal vent channel is located in the first terminal and provides a path for the outgassing of debris during the overcurrent event.

Another exemplary embodiment of a fuse assembly in accordance with the present disclosure may include a fuse element, a first fuse housing, a second fuse housing, and a terminal. The fuse element breaks in response to an overcurrent event, resulting in outgassing debris. The first fuse housing has a first side wall and the second fuse housing has a second side wall. The first side wall mates with the second side wall when the first fuse housing mates with the second fuse housing, which forms a cavity with the fuse element being in the cavity. The terminal includes a terminal vent channel. The terminal vent channel is located over the first side wall and forms a path for movement of the outgas sing debris.

DETAILED DESCRIPTION

A fuse assembly features a terminal vent channel formed in a terminal by coining or milling operations. The terminal vent channel is located over a side wall of the fuse housing and is sized so that openings are formed on either side of the side wall when the terminal is disposed between the two parts of the fuse housing. The openings provide a path for the outgassing of debris during breakage of the fuse element. Various shapes of the terminal vent channel are possible. The terminal vent channel provides an alternative to vents formed in the housing of the fuse assembly.

For the sake of convenience and clarity, terms such as "top", "bottom", "upper", "lower", "vertical", "horizontal", "lateral", "transverse", "radial", "inner", "outer", "left", and "right" may be used herein to describe the relative placement and orientation of the features and components, each with respect to the geometry and orientation of other features and components appearing in the perspective, exploded perspective, and cross-sectional views provided herein. Said terminology is not intended to be limiting and includes the words specifically mentioned, derivatives therein, and words of similar import.

Figure 1A:
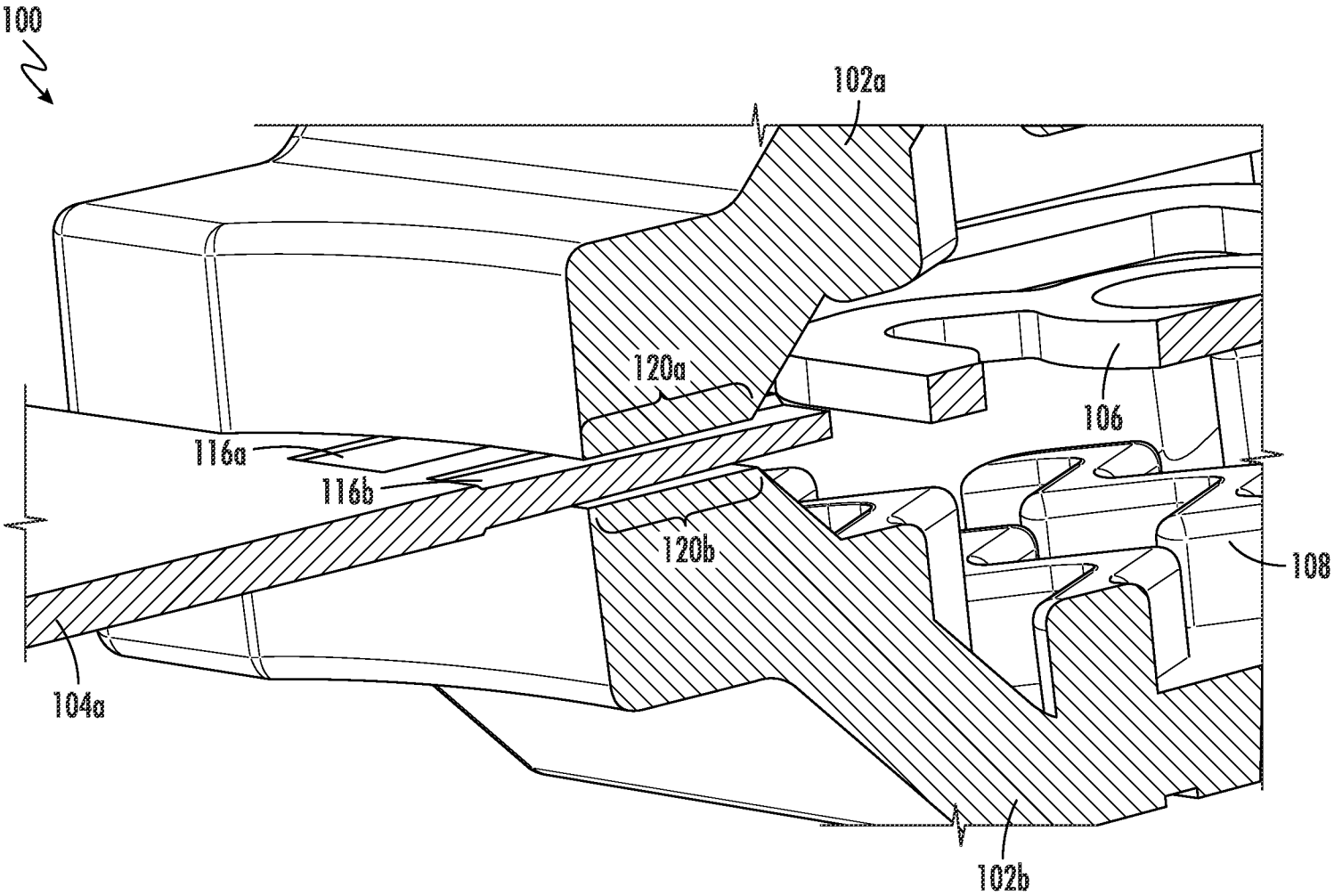
FIGS. 1A-1B are diagrams illustrating a fuse assembly, in accordance with exemplary embodiments.
Figure 1B:
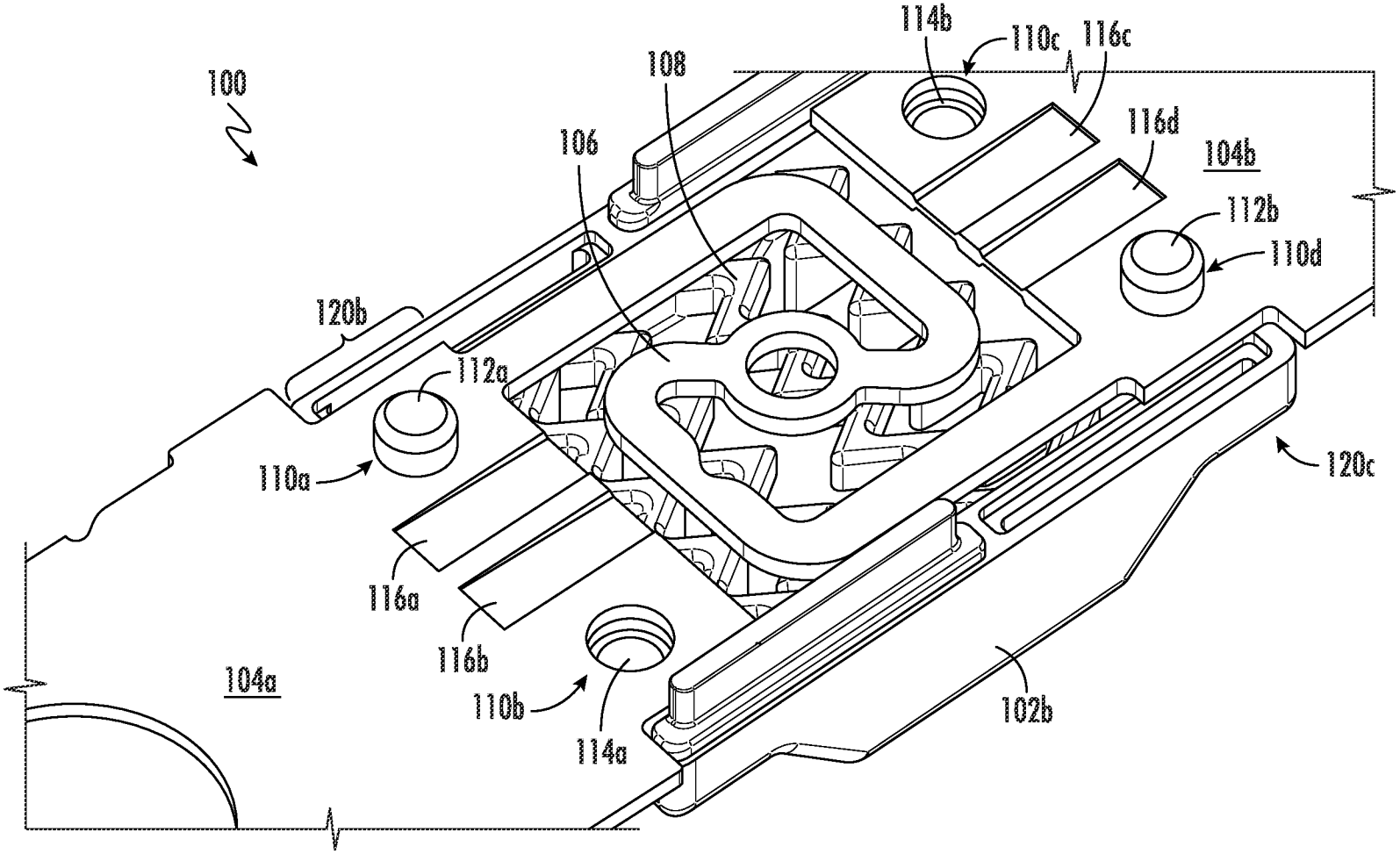

FIGS. 1A-1B are representative drawings of a fuse assembly 100 to facilitate the outgassing of debris, according to exemplary embodiments. The fuse assembly 100 includes a fuse housing 102*a* disposed on one side of a fuse element 106 and a fuse housing 102*b* disposed on the other side of the fuse element (collectively, "fuse housing 102"). The fuse housing 102 is made of a non-conductive material, such as plastic, and forms a cavity for protecting the fuse element 106. When the fuse housing 102*a* mates with the fuse housing 102*b*, the fuse element 106 is disposed in an enclosure therebetween. In a non-limiting example, the fuse housing 102*a* may be identical to the fuse housing 102*b*.

As used herein, outgassing refers to the movement of gaseous material that follows the explosion inside the fuse assembly 100 once the fuse element breaks. Outgassing debris refers to the movement of all material, including gaseous material and also non-gaseous material, such as metal from the fuse element, and plastic from the fuse housing, the latter of which may become carbonized during the explosion. Thus, outgassing debris refers to any and all materials that move both within and outside the fuse housing following the breakage of the fuse element.

The fuse element 106 is disposed between a first terminal 104*a* and a second terminal 104*b* (collectively, "terminal(s) 104"). The fuse element 106 and the terminals 104 are made of an electrically conductive material, such as copper. Because the fuse element 106 is the intentional weak link of the fuse assembly 100, the fuse element 106 may be thinner than the terminals 104.

Ribs 108 are disposed within an interior surface of the fuse housing 102. The ribs 108 are visible in the fuse housing 102*b*, although the fuse housing 102*a* may also feature ribs (not shown). Typically formed with and of the same material as the fuse housing 102, the ribs 108 increase the surface area of the interior of the fuse housing. The increased surface area of the ribs 108 provide locations for deposition of the resulting debris once the fuse element 106 breaks. The ribs 108 may be arranged as a zig-zag, cross-hatch, circular, pyramid, or any other pattern.

The fuse housing 102 includes protrusions and voids for coupling the two elements together. As shown in FIG. 1B, fuse housing 102*b* includes two protrusions 112*a* and 112*b* and two voids 114*a* and 114*b* (collectively, "protrusions 112" and "voids 114"). The terminals 104 likewise include apertures 110*a-d*, with a first pair of apertures 110*a* and 110*b* being part of terminal 104*a* and a second pair of apertures 110*c* and 110*d* being part of terminal 104*b* (collectively, "apertures 110"). Aperture 110*a* is disposed over protrusion 112*a*; aperture 110*b* is disposed over void 114*a*; aperture 110*c* is disposed over void 114*b*; and aperture 110*d* is disposed over protrusion 112*b*. Once placed over the terminals 104, protrusions of fuse housing 102*a* will fit through respective apertures 110 and into the voids 114 of fuse housing 102*b*. Similarly, protrusions 112 of fuse housing 102*b* will fit through respective apertures 110 and into the voids of fuse housing 102*a*. In this manner, the components are able to be fixably mated to one another.

In exemplary embodiments, the apertures 110 are circular cutouts of the respective terminals 104. Similarly, the protrusions 112 and the voids 114 are cylindrical, with diameters that approximate the diameter of the apertures 110. Alternatively, the apertures 110, the protrusions 112, and the voids 114 may be shaped differently than is illustrated, as the particular shape of these elements of the fuse assembly 100 are not meant to be limiting.

In exemplary embodiments, the fuse assembly 100 features terminal vent channels to provide a path for outgassing of debris following a break of the fuse element 106 resulting from an overcurrent event. Vent channels 116*a* and 116*b* are adjacent to one another and disposed between apertures 110*a* and 110*b* of terminal 104*a*. Vent channels 116*c* and 116*d* are adjacent to one another and disposed between apertures 110*c* and 110*d* of terminal 104*b* (collectively, "vent channel(s) 116" and "terminal vent channel(s) 116").

In exemplary embodiments, the fuse housing 102*b* includes side walls over which the terminal vent channels are disposed. Side wall 120*a* is part of the fuse housing 102*a* and side walls 120*b* and 120*c* are part of the fuse housing 102*b* (collectively, "side walls 120"). The side wall 120*b* includes the protrusion 112*a* and the void 114*a* while the side wall 120*c* includes the protrusion 112*b* and the void 114*b*. The side wall 120*a* mates with the side wall 120*b* when the fuse housing 102*a* mates with the fuse housing 102*b*. Additionally, in exemplary embodiments, the side wall 120*a* is disposed above the terminal vent channels 116*a* and 116*b*, the side wall 120*b* is disposed beneath the terminal vent channels 116*a* and 116*b*, and the side wall 120*c* is disposed beneath the terminal vent channels 116*c* and 116*d*.

In exemplary embodiments, the vent channels 116 are formed within respective terminals 104 by a material removal or reduction process. In some embodiments, the vent channels 116 are formed in the terminals 104 by coining operations. Coining is a closed die forging process in which pressure is applied on the surface of the material. Coining is a method of precision stamping in which the metal work piece is subjected to high stress to induce deformation in the shape of the die. In other embodiments, the vent channels 116 are formed in the terminals 104 by milling operations. Milling is a process of machining using rotary cutters to remove material by advancing a cutter into a workpiece. In either case, material is removed from the terminals 104 of the fuse assembly 100 to create controlled dimension channels.

In contrast to forming vent channels in the plastic material of the fuse assembly 100 (such as the fuse housing 102), the dimension of the vent channels 116 is more easily controllable using metal fabrication processes such as coining or milling, in some embodiments. Vent channels formed into the plastic material of the housing could be damaged from assembly processes such as ultrasonic welding. Where the vent channels of the fuse assembly are to be precisely controlled, metal fabrication is thus more accurate than plastic molding. Further, the metal fabrication processes are more cost effective than plastic molding processes, in some embodiments. The ability to customize vent channels that form precise paths for the egress of debris is also easier with the metal than the plastic, in some embodiments.

Figure 2A:
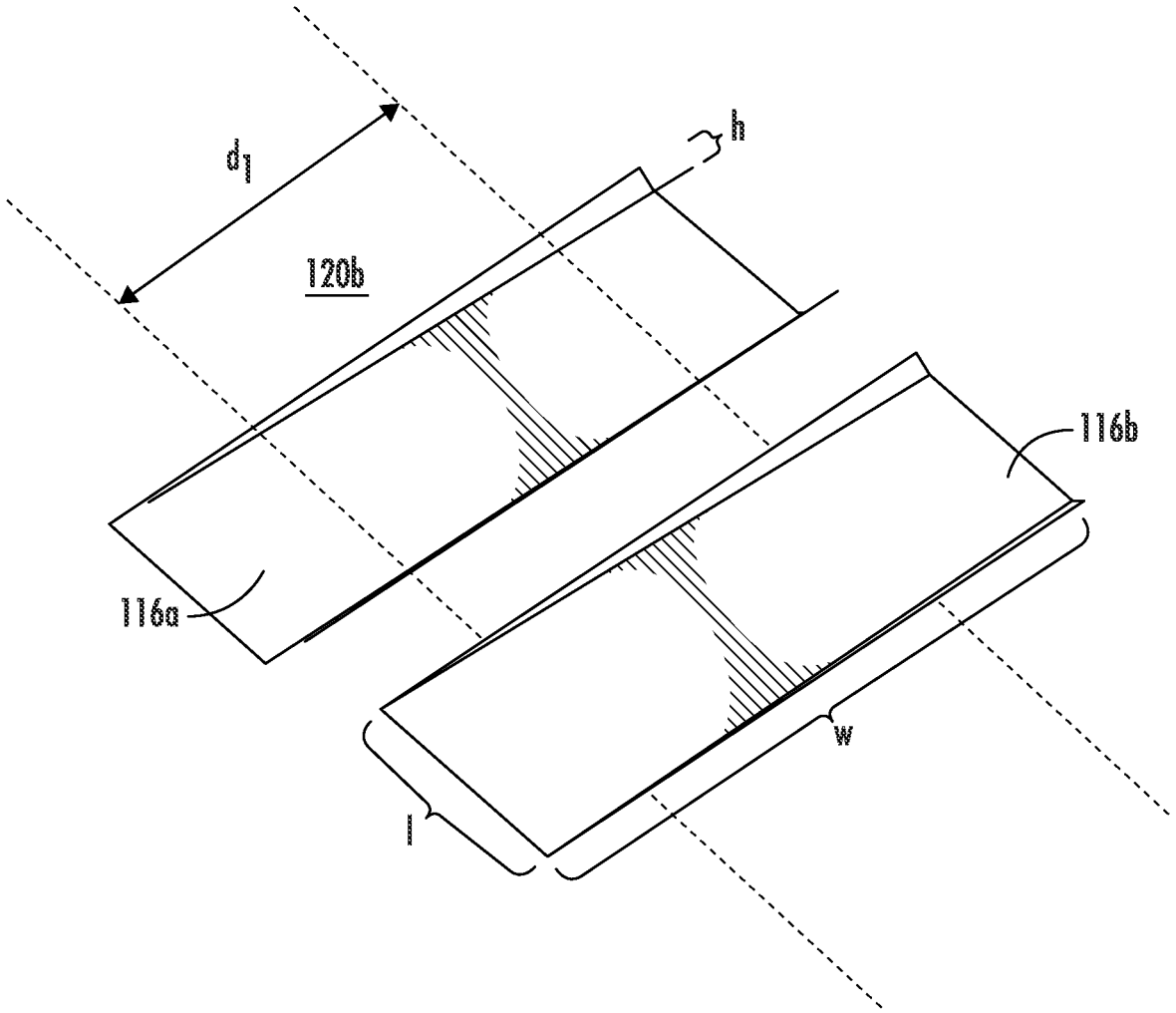
FIGS. 2A-2B are diagrams illustrating terminal vent channels of the fuse assembly of FIGS. 1A-1B, in accordance with exemplary embodiments.
Figure 2B:
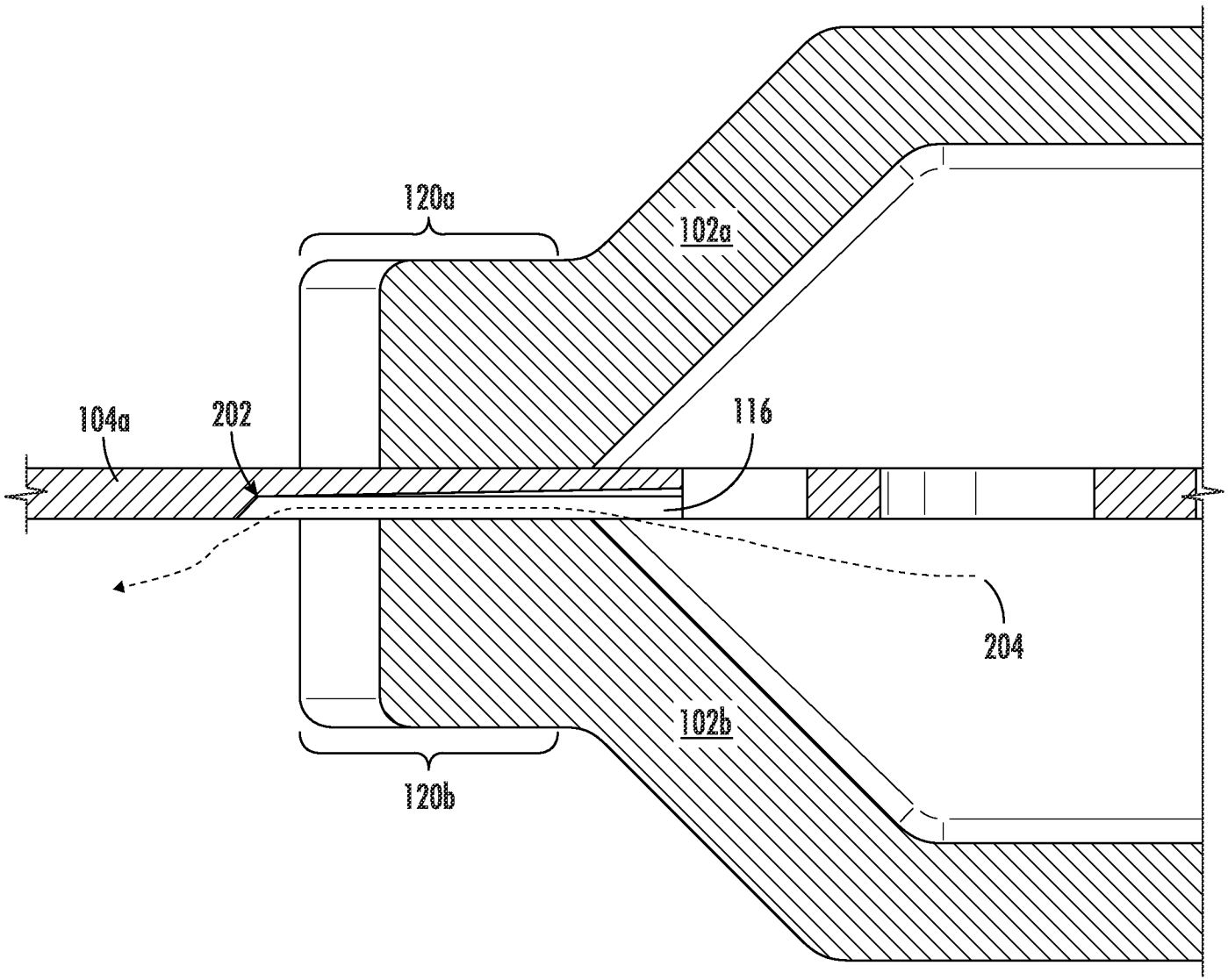

FIGS. 2A and 2B are representative drawings of the terminal vent channels 116 of the fuse assembly 100, according to exemplary embodiments. FIG. 2A is a perspective view of the terminal vent channels 116 and FIG. 2B is a side view of the terminal vent channels disposed between the fuse housing 102. In FIG. 2A, terminal vent channels 116*a* and 116*b* are shown. In exemplary embodiments, the terminal vent channels 116 form triangular wedge-shaped cuts into the respective terminals 104. In exemplary embodiments, the triangular wedge shapes have a length, l, a width, w, and a height, h, with the height being substantially smaller than the length or width. Stated mathematically, the terminal vent channels 116 have the following characteristics: dimension $l \times w \times h$, with $h \ll l$ and $h \ll w$.

The side wall 120*b* of the fuse housing 102*b* is shown with dotted lines. The side wall 120*b* has a dimension, $d_1$. In exemplary embodiments, the width, w, of the terminal vent channels 116 is larger than the dimension, $d_1$. Stated mathematically, $w > d_1$. Beyond this limitation, the vent channels 116 may be shaped differently than the rectangular shape illustrated in FIG. 2A. This relationship between the width of the side wall 120*b* versus the width of the terminal vent channels 116 ensures that there will be openings which form a path for the outflow of debris during the overcurrent event.

In FIG. 2B, the terminal 104*a* is disposed between the side wall 120*a* of fuse housing 102*a* and the side wall 120*b* of fuse housing 102*b*. The position of the terminal vent channel(s) 116 results in an opening 202 between the terminal 104*a* and the fuse housing 102*a*. In exemplary embodiments, the terminal vent channel 116 provides a debris path 204 for debris to travel from the interior chamber of the fuse assembly 100 to outside the fuse assembly.

The fuse assembly 100 shows that, through material removal/reduction processes such as coining/milling, controlled dimension channels such as the terminal vent channels 116 can be added to the terminals of higher voltage fuses, in exemplary embodiments. One of the specifications of a fuse is known as open state resistance (OSR). This characteristic indicates how likely the fuse will maintain a high resistance (thus continuing to block current) after breaking. A properly vented fuse may have a higher OSR than one that is not vented. Further, higher voltage fuses experience much more arc energy than lower voltage fuses. When matched with the assembled plastic of the fuse housing 102, the terminal vent channels 116 that are part of the terminals 104 of the fuse assembly 100 create small openings for pressure and debris relief during high breaking capacities, in exemplary embodiments. Further, because the vent channels 116 are formed in metal (the terminals 104), a higher degree of accuracy in their formation is possible, in some embodiments, in contrast to what is possible with forming vent channels in plastic housing.

Figure 3A:
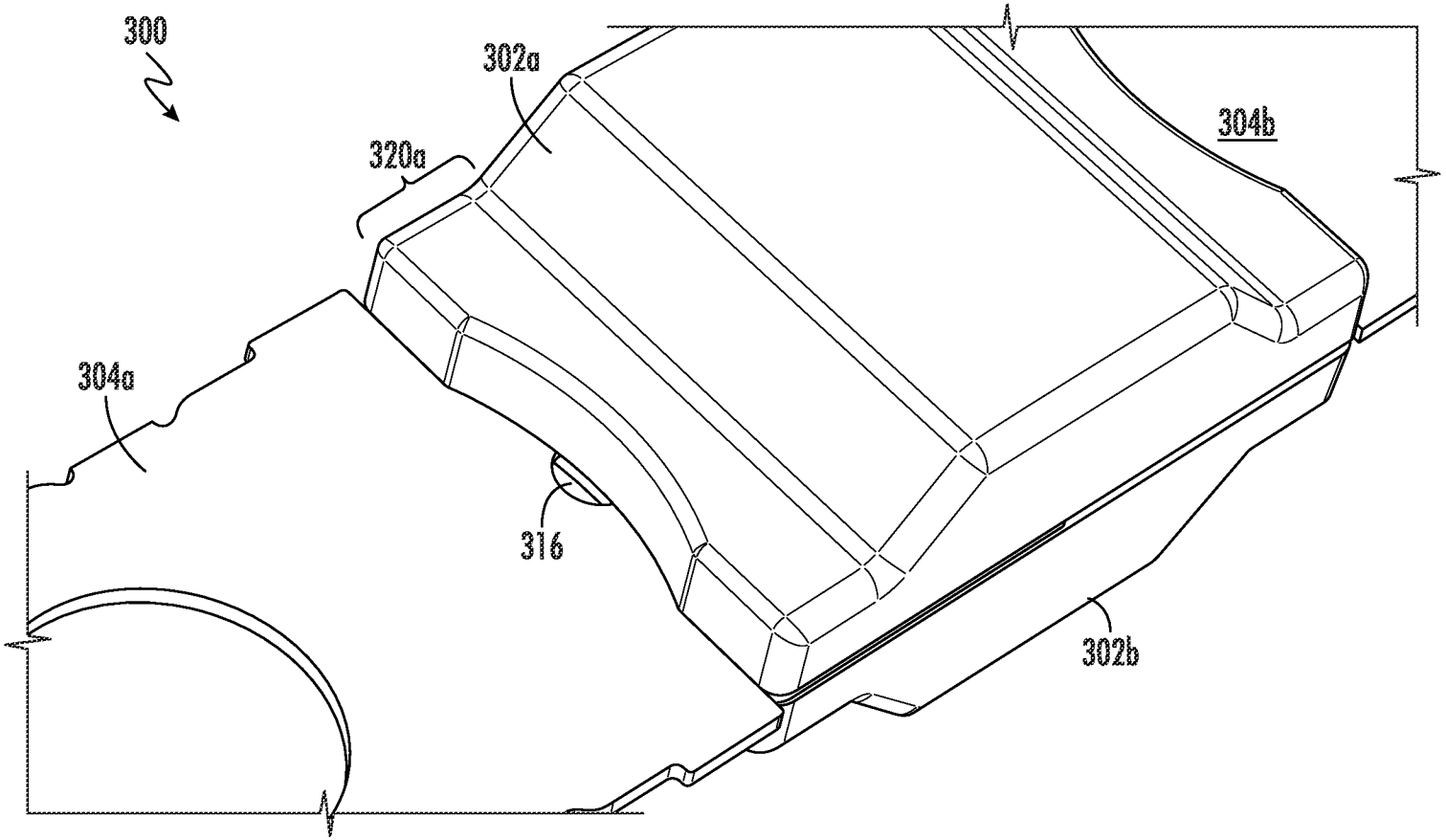
FIGS. 3A-3B are diagrams illustrating a fuse assembly, in accordance with exemplary embodiments.
Figure 3B:
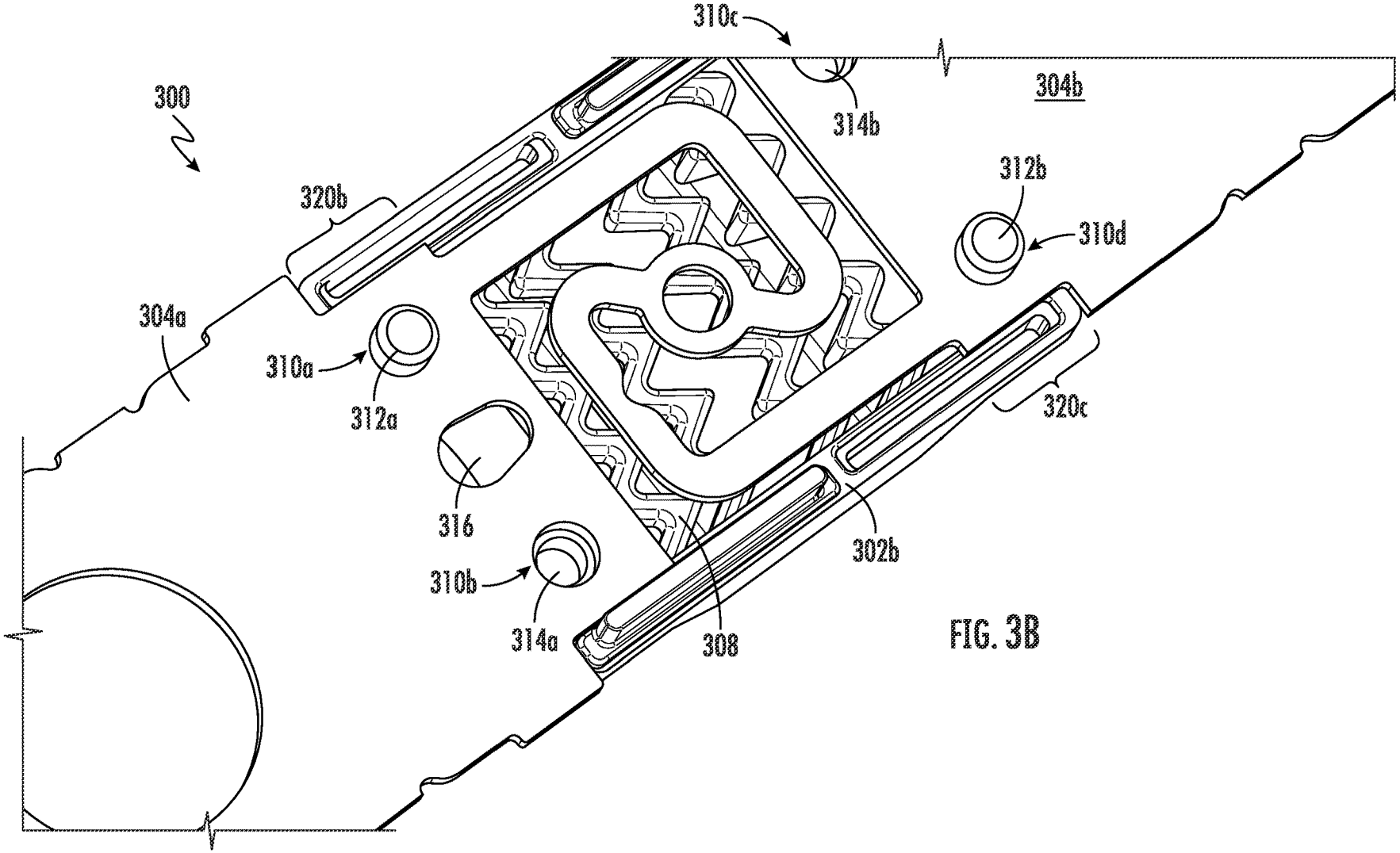

FIGS. 3A and 3B are representative drawings of a fuse assembly 300 to facilitate the outgassing of debris, according to exemplary embodiments. The fuse assembly 300 includes a fuse housing 302*a* disposed on one side of a fuse element 306 and a fuse housing 302*b* disposed on the other side of the fuse element (collectively, "fuse housing 302"). The fuse housing 302 is made of a non-conductive material, such as plastic, and forms a cavity for protecting the fuse element 306. When the fuse housing 302*a* mates with the fuse housing 302*b*, the fuse element 306 is disposed in an enclosure therebetween. In a non-limiting example, the fuse housing 302*a* may be identical to the fuse housing 302*b*.

The fuse element 306 is disposed between a first terminal 304*a* and a second terminal 304*b* (collectively, "terminal(s) 304"). The fuse element 306 and the terminals 304 are made of an electrically conductive material, such as copper. Because the fuse element 306 is the intentional weak link of the fuse assembly 300, the fuse element 306 may be thinner than the terminals 304.

Ribs 308 are disposed within an interior surface of the fuse housing 302. The ribs 308 are visible in the fuse housing 302*b*, although the fuse housing 302*a* may also feature ribs (not shown). Typically formed with and of the same material as the fuse housing 302, the ribs 308 increase the surface area of the interior of the fuse housing. The increased surface area of the ribs 308 provide locations for deposition of the resulting debris once the fuse element 306 breaks. The ribs 308 may be arranged as a zig-zag, cross-hatch, circular, pyramid, or any other pattern.

The fuse housing 302 includes protrusions and voids for coupling the two elements together. As shown in FIG. 3B, fuse housing 302*b* includes two protrusions 312*a* and 312*b* and two voids 314*a* and 314*b* (collectively, "protrusions 312" and "voids 314"). The terminals 304 likewise include apertures 310*a-d*, with apertures 310*a* and 310*b* being part of terminal 304*a* and apertures 310*c* and 310*d* being part of terminal 304*b* (collectively, "apertures 310"). Aperture 310*a* is disposed over protrusion 312*a*; aperture 310*b* is disposed over void 314*a*; aperture 310*c* is disposed over void 314*b*; and aperture 310*d* is disposed over protrusion 312*b*. Once placed over the terminals 304, protrusions of fuse housing 302*a* will fit through respective apertures 310 and into the voids 314 of fuse housing 302*b*. Similarly, protrusions 312 of fuse housing 302*b* will fit through respective apertures 310 and into the voids of fuse housing 302*a*. In this manner, the components are able to be fixably mated to one another.

In exemplary embodiments, the apertures 310 are circular cutouts of the respective terminals 304. Similarly, the protrusions 312 and the voids 314 are cylindrical, with diameters that approximate the diameter of the apertures 310. Alternatively, the apertures 310, the protrusions 312, and the voids 314 may be shaped differently than is illustrated, as the particular shape of these elements of the fuse assembly 300 are not meant to be limiting.

In exemplary embodiments, the fuse assembly 300 features a terminal vent channel to provide a path for outgassing of debris following a break of the fuse element 306 resulting from an overcurrent event. A vent channel 316 (also known herein as a "terminal vent channel 316") is disposed between apertures 310*a* and 310*b* of terminal 304*a*. Although not shown in FIG. 3B, a second vent channel could be disposed between apertures 310*c* and 310*d* of terminal 304*b*.

In exemplary embodiments, the vent channel 316 is formed within respective terminals 104 by a material removal or reduction process. In some embodiments, the vent channel 316 is formed in the terminal 304*a* by blanking or piercing operations, which are machining processes used to cut holes in metal, such as metal sheets. In other embodiments, the vent channel 316 is formed in the terminal 304*a* by milling operations. In either case, material is removed from the terminal 304*a* of the fuse assembly 300 to create the controlled dimension channel.

In exemplary embodiments, as illustrated in FIG. 3B, the fuse housing 302*b* includes side walls 320*a*, 320*b*, and 320*c* (collectively, "side walls 320"). The side wall 320*b* includes the protrusion 312*a* and the void 314*a*. Similarly, the side wall 320*c* includes the void 314*b* and the protrusion 312*b*. The side walls 320 mate when the respective fuse housing 302*a* and 302*b* mate with each other. Additionally, in exemplary embodiments, the side wall 320*b* is disposed beneath the terminal vent channel 316.

Figure 4A:
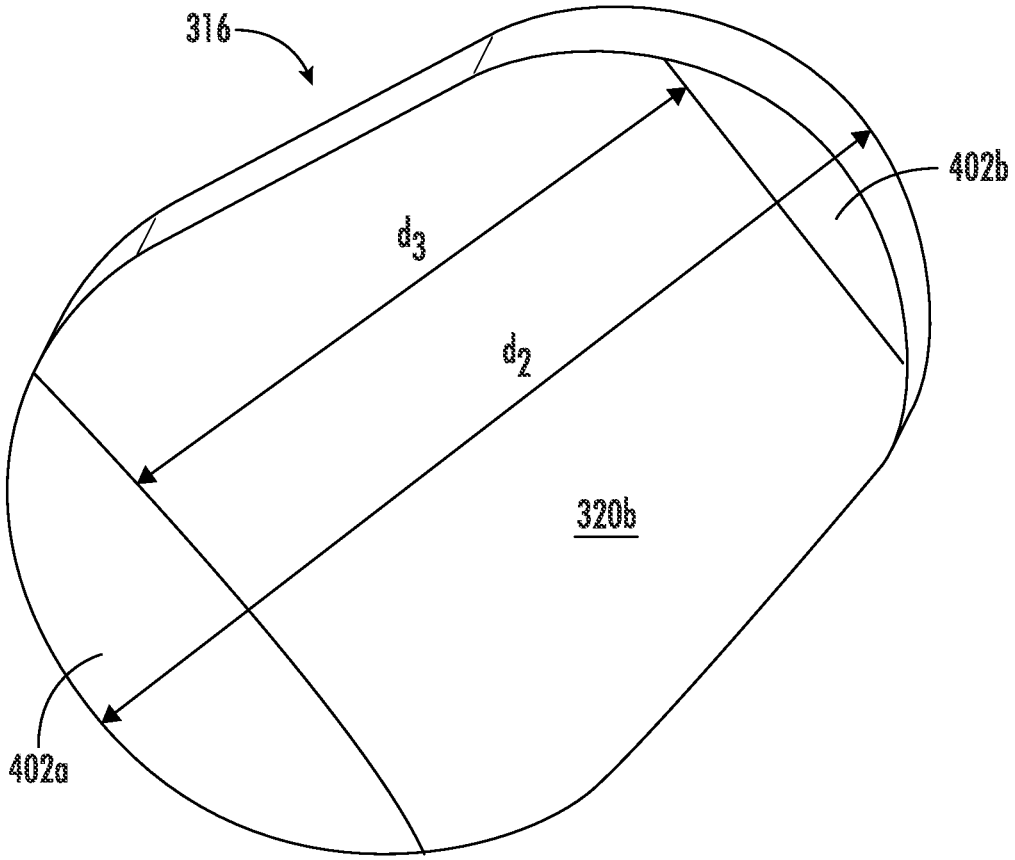
FIGS. 4A-4B are diagrams illustrating a terminal vent channel of the fuse assembly of FIGS. 3A-3B, in accordance with exemplary embodiments.
Figure 4B:
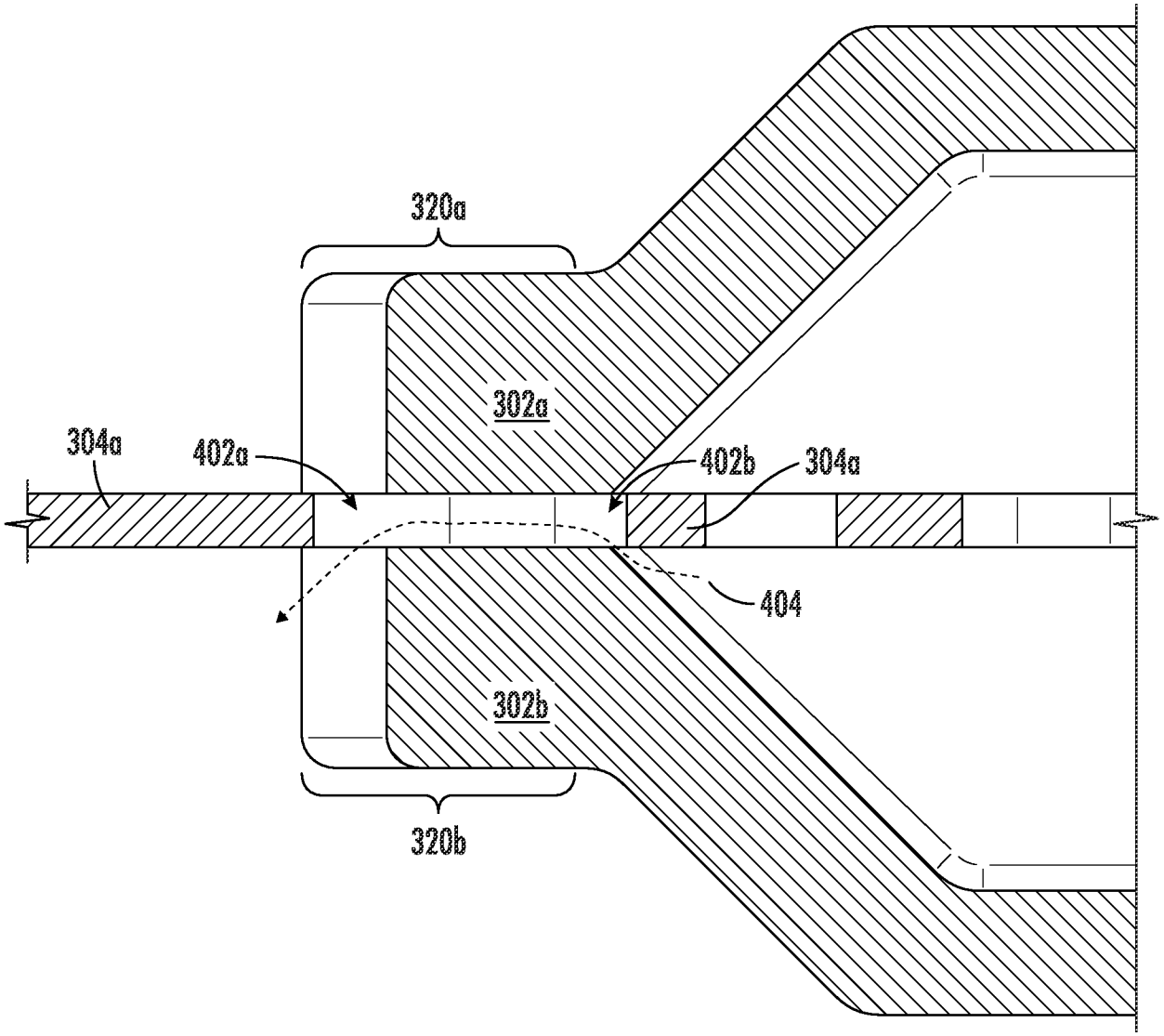

FIGS. 4A and 4B are representative drawings of the terminal vent channel 316 of the fuse assembly 300, according to exemplary embodiments. FIG. 4A is a perspective view of the terminal vent channel 316 and FIG. 4B is a side view of the terminal vent channel disposed between the fuse housing 302. With reference also to FIG. 3B, the fuse housing 302*b* has side walls 320*b* and 320*c*, with the terminal vent channel 316 being disposed over the side wall 320*b*. In a non-limiting example, the terminal vent channel 316 is shown having an oblong shape, although the terminal vent channel may be shaped differently. In exemplary embodiments, the terminal vent channel 316 has a dimension, $d_2$, at its longest point while the distance across the side wall 320*b* is $d_3$. In exemplary embodiments, $d_2$ is longer than $d_3$ ($d_2>d_3$). Put another way, the terminal vent channel 316 overlaps the width of the side wall 320*b*. The arrangement of the terminal vent channel 316 to overlap the side wall 320*b* results in two openings 402*a* and 402*b* (collectively, "openings 402"), with the opening 402*b* being over the fuse chamber and the opening 402*a* being external to the fuse chamber.

In FIG. 4B, the terminal 304*a* is disposed between the fuse housing 302*a* and the fuse side wall 320*b* of the fuse housing 302*b*. Openings 402*a* and 402*b*, shown also in FIG. 4A, are disposed on either side of the fuse housing 302. The position of the terminal vent channel 316 results in the openings 402 between the terminal 304*a* and the fuse housing 302. In exemplary embodiments, the terminal vent channel 316 provides a debris path 404 for debris to travel from the interior chamber of the fuse assembly 300 to outside the fuse assembly.

The fuse assembly 100 shows four terminal vent channels 116, two on one terminal and two on another terminal. The fuse assembly 300 shows a single terminal vent channel on one of the two terminals. Combinations of these configurations are possible. For example, the fuse assembly 300 may have two terminal vent channels 316 disposed adjacent one another between the apertures 310 of the terminals 304. Further, both terminals 304 of the fuse assembly 300 may include terminal vent channels 316. Or the fuse assembly 100 may have a single terminal vent channel 116 disposed between apertures 110 of the terminals 104. Further, the fuse assemblies 100 and 300 may feature both types of terminal vent channels 116 and 316. Other combinations are possible as well, as the illustrations are not meant to be limiting.

Figure 5:
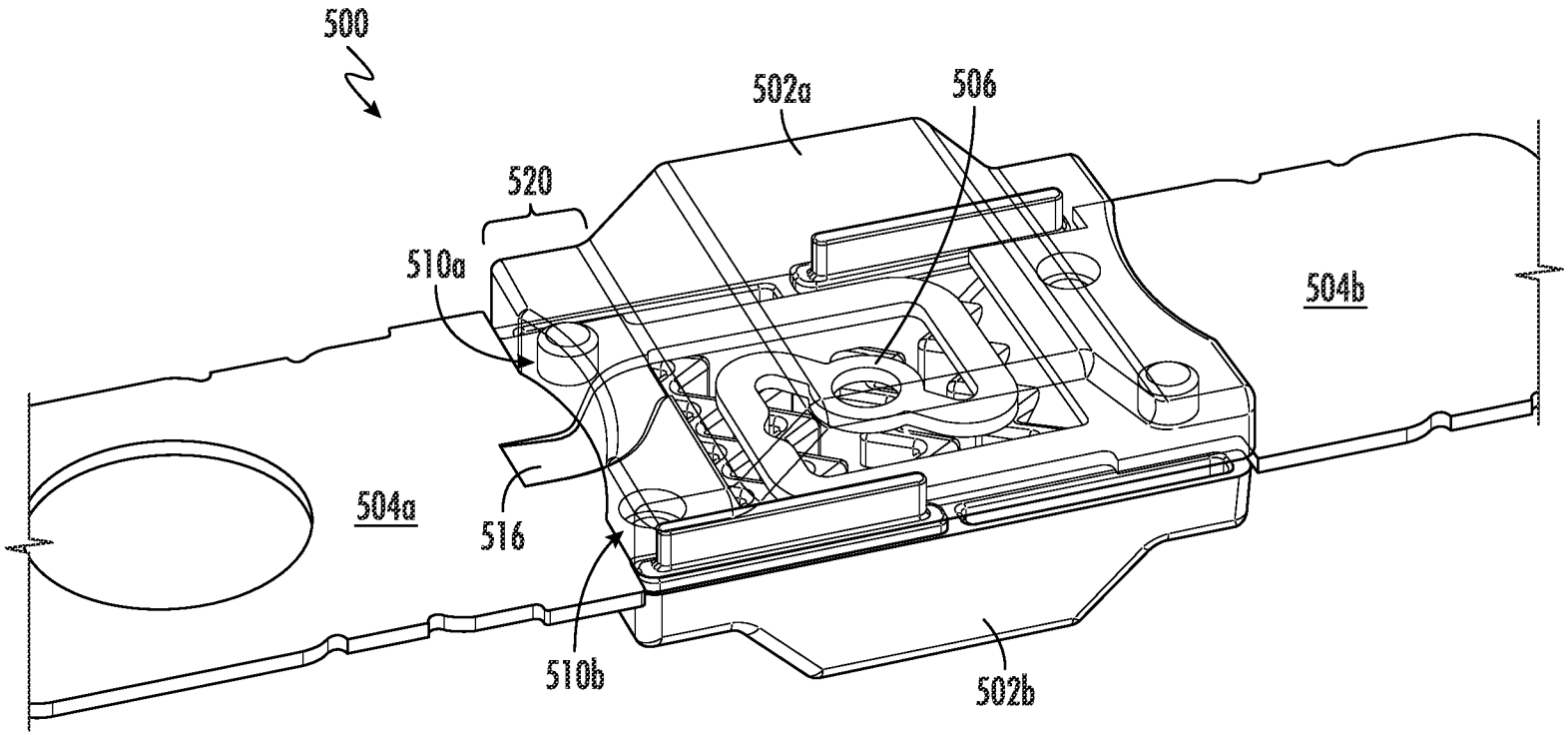
FIG. 5 is a diagram illustrating a fuse assembly, in accordance with exemplary embodiments.

FIG. 5 is a representative drawing of a fuse assembly 500 to facilitate the outgassing of debris, according to exemplary embodiments. The fuse assembly 500 includes a fuse housing 502*a* disposed on one side of a fuse element 506 and a fuse housing 502*b* disposed on the other side of the fuse element (collectively, "fuse housing 502"). The fuse housing 502*a* is transparent so that other features of the fuse assembly 500 are visible. The fuse housing 502 is made of a non-conductive material, such as plastic, and forms a cavity for protecting the fuse element 506. When the fuse housing 502*a* mates with the fuse housing 502*b*, the fuse element 506 is disposed in an enclosure therebetween. In a non-limiting example, the fuse housing 502*a* may be identical to the fuse housing 502*b*.

The fuse element 506 is disposed between a first terminal 504*a* and a second terminal 504*b* (collectively, "terminal(s) 504"). The fuse element 506 and the terminals 504 are made of an electrically conductive material, such as copper. Because the fuse element 506 is the intentional weak link of the fuse assembly 500, the fuse element 506 may be thinner than the terminals 504.

The fuse assembly 500 features other elements found in fuse assemblies 100 and 300, such as ribs, protrusions, and voids. For simplicity of explanation, these elements are not called out in FIG. 5. Nevertheless, the terminals 504 of the fuse assembly 500 are arranged between the fuse housing 502 in a fashion similar to the fuse assemblies 100 and 300.

Apertures 510*a* and 510*b* are called out as part of terminal 504*a*, although terminal 504*b* similarly includes apertures as shown (collectively, "apertures 510"). Between the apertures 510*a* and 510*b*, in exemplary embodiments, the fuse assembly 500 features a terminal vent channel 516 to provide a path for outgassing of debris following a break of the fuse element 506.

In exemplary embodiments, the fuse housing 502*b* includes a side wall 520 over which the terminal vent channel 516 is disposed. The side wall 520 is called out because its width, like the width of side walls 120 (fuse assembly 100) and 320 (fuse assembly 300) determines the dimension of the terminal vent channel 516. Namely, the terminal vent channel 516 is wider than the side wall 520, ensuring that there is an opening within the enclosure of the fuse assembly 500 (where the fuse element 506 is located) and an opening external to the fuse housing 502. In exemplary embodiments, the terminal vent channel 516 includes a bend that is closer to aperture 510*a* than to aperture 510*b*. The terminal vent channel 516 may be described as somewhat S-shaped. The bending of the terminal vent channel 516 may be based on the configuration of the fuse element 506, in some embodiments. Although not shown in FIG. 5, the terminal 504 may similarly include a terminal vent channel.

In exemplary embodiments, the terminal vent channel 516 is formed within the terminal 504 by a material removal or reduction process, such as milling or coining, with material being removed from the terminal 504 of the fuse assembly 500 to create a controlled dimension channel.

The fuse assemblies 100, 300, and 500 thus provide terminal vent channels to facilitate outgassing of debris following an overcurrent event in which fuse elements are broken. In contrast to legacy fuse assemblies, the terminal vent channels are formed within the terminals rather than formed within the housing, as vent channel formation in plastic is less accurate and more expensive than in metal, in some embodiments. Further, in exemplary embodiments, the ability to customize precise shapes for the vent channels is more successful in metal than in plastic, in exemplary embodiments.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A fuse assembly comprising:

a fuse housing;

a fuse element disposed within the fuse housing and extending between a first terminal and a second terminal, the fuse element to break in response to an overcurrent event, wherein the first terminal and the second terminal extend outside of the fuse housing; and a terminal vent channel formed in the first terminal, the terminal vent channel abutting the fuse housing and extending from a first end within the fuse housing to a second end outside of the fuse housing for providing a path for outgassing of debris during the overcurrent event.

2. The fuse assembly of claim 1, further comprising:

a first pair of apertures cut into the first terminal; and a second pair of apertures cut into the second terminal.

3. The fuse assembly of claim 2, wherein the terminal vent channel is disposed in between the first pair of apertures.

4. The fuse assembly of claim 2, further comprising a second terminal vent channel to provide a second path for outgassing of debris during the overcurrent event.

5. The fuse assembly of claim 4, wherein the second terminal vent channel is formed in the first terminal adjacent the terminal vent channel.

6. The fuse assembly of claim 4, wherein the second terminal vent channel is formed in the second terminal and disposed between the second pair of apertures.

7. A fuse assembly comprising:

a fuse element to break in response to an overcurrent event, resulting in outgassing debris;

a first fuse housing comprising a first side wall;

a second fuse housing comprising a second side wall, wherein the first side wall mates with the second side wall when the first fuse housing mates with the second fuse housing, with the fuse element disposed in a cavity therebetween; and a terminal extending from the fuse element outside of the cavity, the terminal having a terminal vent channel formed therein, wherein the terminal vent channel abuts at least one of the first fuse housing and the second fuse housing and extends from a first end within the cavity to a second end outside of the cavity for providing a path for movement of outgassing debris.

8. The fuse assembly of claim 7, wherein the first side wall has a first dimension and the terminal vent channel has a second dimension that is different from the first dimension.

9. The fuse assembly of claim 8, wherein the second dimension is larger than the first dimension.

* * * * *